United States Patent [19]

Gutner

[11] 4,279,264

[45] Jul. 21, 1981

[54] CANOPY SUPPORT FOR BEDS AND METHOD

[76] Inventor: Kenneth H. Gutner, 3285 Dato, Highland Park, Ill. 60035

[21] Appl. No.: 115,947

[22] Filed: Jan. 28, 1980

[51] Int. Cl.[3] ..... A47C 29/00

[52] U.S. Cl. ..... 135/5.1; 5/414; 29/428; 29/526 R

[58] Field of Search ..... 135/5 R, 5.2, 97, 5.1; 5/113, 414; 248/159, 418; 29/428, 526 R

[56] References Cited

U.S. PATENT DOCUMENTS

| | | | |
|---|---|---|---|
| 2,667,916 | 2/1954 | Burd | 5/191 |
| 3,311,118 | 3/1967 | Gutner | 135/5.2 |
| 4,068,333 | 1/1978 | Gutner | 5/414 |

*Primary Examiner*—Roy D. Frazier
*Assistant Examiner*—Alexander Gross
*Attorney, Agent, or Firm*—Tilton, Fallon, Lungmus & Chestnut

[57] ABSTRACT

A canopy support for beds and method wherein the side members and transverse members are all constructed of tubular metal, intermediate of the side members being equipped with L-shaped flanges at the ends thereof for locking insertion into the slots of the side members.

5 Claims, 6 Drawing Figures

CANOPY SUPPORT FOR BEDS AND METHOD

BACKGROUND AND SUMMARY OF INVENTION

This invention relates to a canopy support for beds and method of assembly and, more particularly, to a canopy support featuring a unique locking means between the side and transverse members.

Canopy supports for beds have been known for a long time and historically were constructed of wood. For the most part, such canopy frames had a central arch in the side members giving a distinctive and eye pleasing appearance.

More recently, other materials of construction have been employed for the canopy supports—for example my U.S. Pat. No. 3,311,118 dealt with a support constructed of metal. In view of the fact that the canopy frames were made at one place, sold at another, and erected in the home of the purchaser at still another place, it was most desirable to have "knock-down" supports for convenience of handling and shipping. This emphasized the need for having secure connections between the various parts.

In the interest of reliability and economy, the art made use of other materials of construction such as plastic as seen in my U.S. Pat. Nos. 3,741,225; 4,004,306; 4,068,333 and 4,074,377. Persisting throughout all of the art development was the concern about having a reliable connection between the various parts of the canopy support—it being imperative that the "knock-down" support, when assembled, be secure in view of the fact that it was positioned over a sleeper.

Quite apart from the concern over safety, there has been a continuing and expanding interest on the part of consumers for canopy beds. Many consumers have been concerned about the cost as well as the potential difficulty of self-assembly. Virtually everyone has had the experience of the difficulty in assembling many products, not only children's toys at Christmastime. Cost, of course, is determined not only by the complexity of manufacture but the weight and bulk of the article for the various stages of shipment.

All of these interrelated problems have been solved according to the instant invention which makes use of tubular metal for the various components of the canopy support free of the costly and difficult to manipulate clips or other attaching means and which is secure when assembled against accidental detachment or disassembly. More particularly, the intermediate transverse members are equipped with L-shaped flanges which fit into slots in the side members. The side member sections are initially positioned with the arch portions in a horizontal plane and one leg of the L-shaped flange inserted therein. Then, after the intermediate members are connected at both ends to opposite side member sections, the sections are rotated to place the arch portions in a vertical plane, i.e., in final orientation. This causes the inner leg of the L-shaped flange to be positioned in the slot whereby the outer leg serves as a positive lock. Thus, the canopy support is economically manufactured, lightweight for further economy, easily assembled, and most importantly, safe when assembled. All of these beneficial results from the novel construction and operation which is now set forth in greater detail in the ensuing detailed description.

DETAILED DESCRIPTION

The invention is explained in conjunction with the accompanying drawing, in which.

Figure 1:
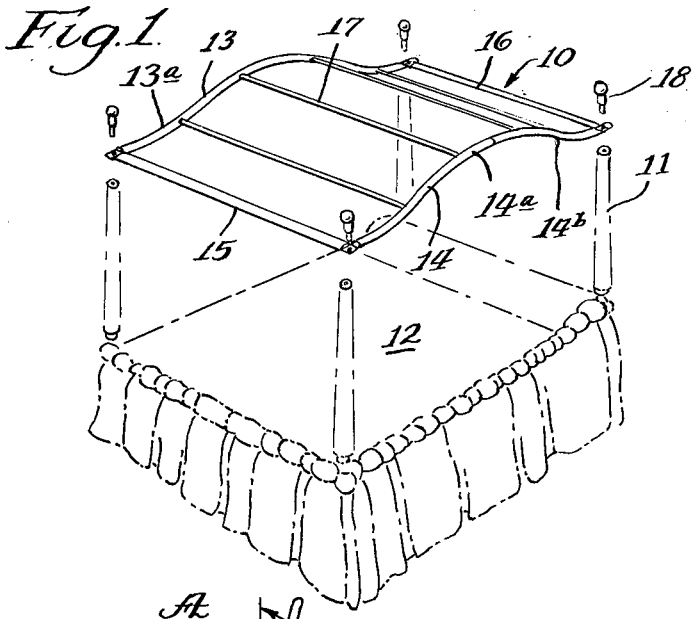
FIG. 1 is a perspective view of the environment of the invention, i.e., a bed shown in phantom line and wherein the inventive canopy support is seen in solid line.

In the illustration given and with reference first to FIG. 1, the numeral 10 designates generally the inventive canopy support or frame which is seen to be installed on upstanding bedposts as at 11. The bedposts 11 are provided as the four corners of the frame of the usual bed 12.

Figure 6:
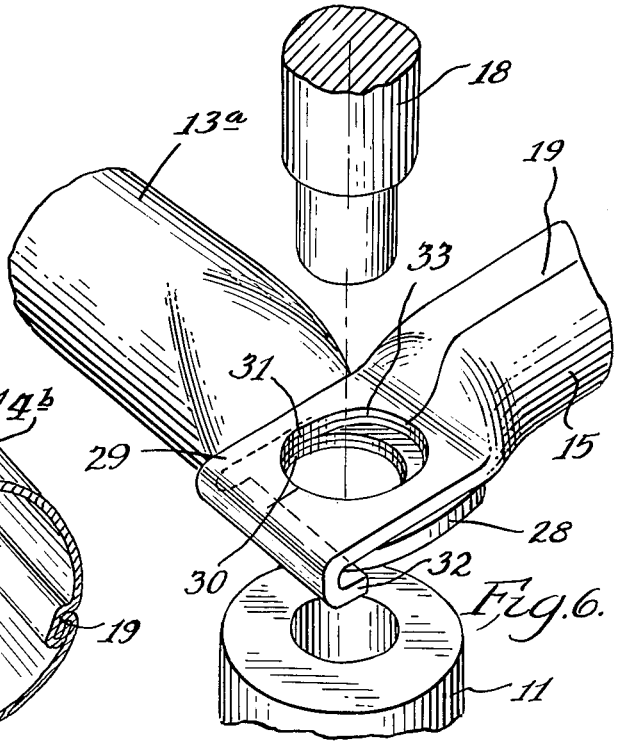
FIG. 6 is another perspective view showing the details of connection between a side member and the end transverse member.

The frame 10 includes a pair of telescoping longitudinally extending side members 13 and 14, a pair of end transverse members 15 and 16 along with a plurality of intermediate transverse members 17. The connection of the frame 10 to the bed posts 11 is still in conventional fashion—making use of finials 18 but in a different fashion as illustrated in FIG. 6 and which will be explained in greater detail hereinafter.

Each side member 13, 14 is divided into a pair of associated sections as at **14*a* and 14*b*. The details of the telescoping sections 14*a* and 14*b* can be seen best in FIG. 5. Both sections are equipped with a longitudinal lock seam as at 19 (still referring to FIG. 5) while one of the sections—as at 14*b*—is radially constricted at the telescoping end—as at the area designated 20 in the lower left hand portion of FIG. 5. This is brought about by crimping opposed portions as at 21 and 22. Thus, the crimped end portion 20 of the section 14*b* can be telescopically received within the uncrimped end of the section 14*a*. The crimping, which defines the grooves 21 and 22, achieves another purpose inasmuch as the groove 21, for example, lines up with the lock seam 19 of the section 14*a* so as to insure that the two sections are properly aligned for developing the central arch (see FIG. 1**).

Figure 2:
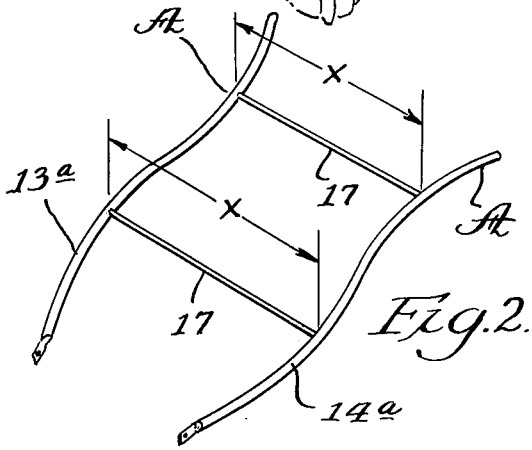
FIG. 2 is a perspective view of two opposed sections of the side members of the canopy support in the initial stage of assembly.

However, prior to the telescopic assembly of the associated sections **14*a* and 14*b*, opposed corresponding sections as at 13*a* and 14*a* are assembled. Reference is now made to FIG. 2 where it is seen that these two sections 13*a* and 14*a* are arranged in a fashion wherein the arch portions A are disposed in a horizontal plane, i.e., the sections 13*a* and 14*a* are laid on the floor. Thereafter, the intermediate transverse members 17** are installed.

Figure 4:
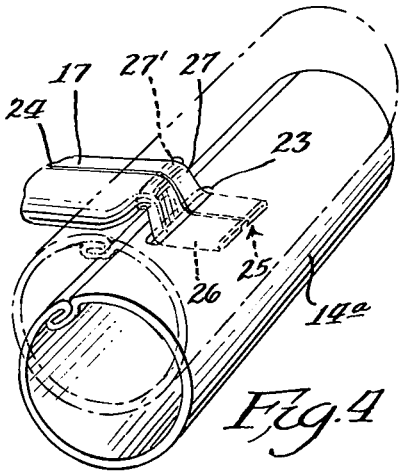
FIG. 4 is a fragmentary perspective view showing the interconnection between a transverse member and a side member section with the solid line showing corresponding to the orientation of FIG. 2 and the phantom showing of the side member section corresponding to the orientation of FIG. 3.

To appreciate the interconnection between the intermediate transverse and side members, reference is made to FIG. 4. In FIG. 4 the portion of the side member shown is again designated 14*a* and it is seen that the member is equipped with a longitudinally extending slot 23 for each intermediate transverse member 17. Each transverse member 17 is advantageously constructed of tubular metal but with just a butt joint as at 24 which facilitates the development of an L-shaped flange generally designated 25 at each end thereof. The L-shaped flange defines an outer leg portion 26 and an inner leg portion 27.

Figure 3:
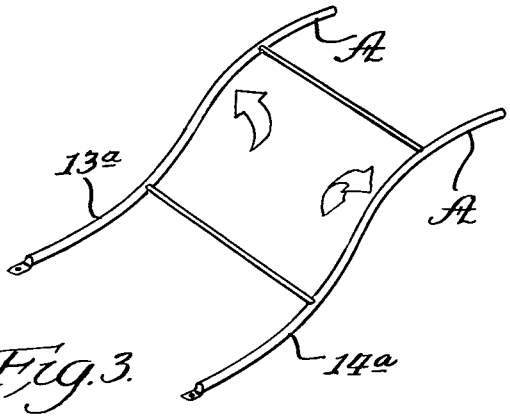
FIG. 3 is another perspective view of the same elements as seen in FIG. 2 but in the stage of final assembly.

When the sections 13*a* and 14*a* are in the orientation of FIG. 2, the outer legs 26 are inserted into the slots 23 of the opposed sections. When all four flanges 25 have been so inserted (as seen in solid line in FIG. 4), the sections 13*a* and 14*a* are grasped by the right and left hand of the homeowner and merely rotated 90° as illustrated by the curved arrows in FIG. 3. This simple action not only orients the side members with the arched portions A thereof in parallel vertical plane but, at the same time, causes the slots 23, in effect, to ride up onto the inner leg 27 of the L-shaped flange 25 in the fashion indicated at 27' in FIG. 4. Thus, the simple rotation not only achieves the desired orientation of the side member sections but also securely locks the intermediate transverse members within the sections.

Figure 5:
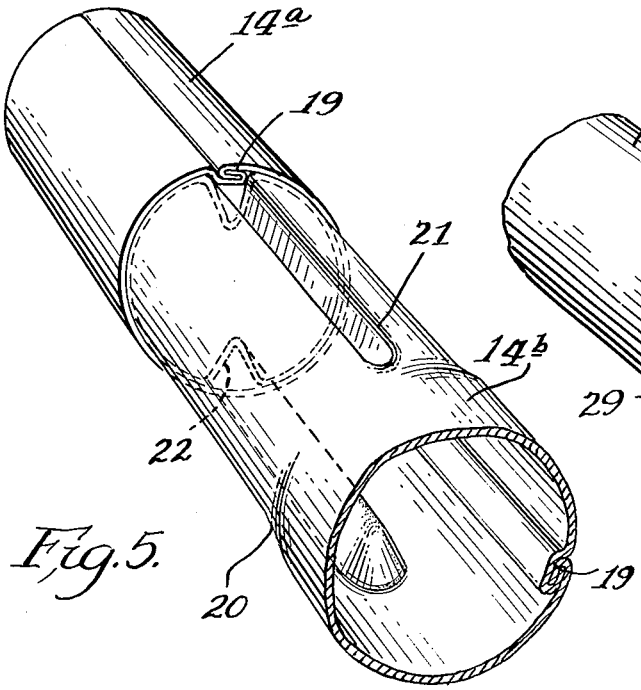
FIG. 5 is another fragmentary perspective view showing the details of the interlock between associated sections of a given side member.

To complete the installation, the associated sections of a particular side member, i.e., 14*a* and 14*b* and the telescopically connected in the fashion depicted in FIG. 5, the end transverse members 15 and 16 installed either in the bedposts 11 or advantageously associated with the side members as seen in FIG. 6, after which the newels 18 are inserted to complete the installation.

Referring now to FIG. 6, it will be seen that the portion of the end transverse member 15 shown therein is of the same basic construction as the side members, i.e., equipped with a lock seam as at 19. The ends of both the side and end transverse members are flattened as at 28 and 29, respectively and the flattened sections 28 and 29 are equipped with aligned openings as at 30 and 31, respectively. This accommodates the insertion of the finial 18. In one preferred embodiment, the flattened section 29 of the end transverse members 15 or 16, as the case may be, is equipped with a return bend as at 32 which provides a J shape to the flattened portion 29 and into which the flattened end 28 of the side member is advantageously received. This rigidifies the entire assembly prior to the time the same is lifted for installation on the bedposts 11.

Still further, one or both of the aligned openings 30 and 31 may be longitudinally enlarged as at 33 (FIG. 6) to permit slight adjustment of the side and end members should the bed width or length dimension be off specification.

While in the foregoing specification a detailed description of an embodiment of the invention has been set down for the purpose of explanation, many variations in the details hereingiven may be made by those skilled in the art without departing from the spirit and scope of the invention.

I claim:

1. A lightweight rugged canopy frame for a bed comprising a pair of side members and a plurality of transverse members all constructed of tubular metal, said side members each including a pair of end connected sections, each pair of sections when connected forming an arch midway of the length thereof, said transverse members including a pair of end members, said side and end members being equipped with openings adjacent the ends thereof for connection to the bedposts, said transverse members also including a plurality of intermediate members each formed into a tube with a butt seam, said intermediate members being crimped at the ends thereof to provide a generally L-shaped flange at each end, said side members being equipped with elongated slots in transversely aligned, longitudinally spaced apart positions to receive said flanges, said frame being assembled by inserting the outer leg of said L-shape into an associated slot and thereafter rotating the said side member section to insert the inner leg of said L-shape in said slot whereby said outer legs cooperate to lock said frame in arch providing attitude.

2. The structure of claim 1 in which each end member has a return bend at the ends thereof defining a slot for the receipt of the end of one of said side members, and aligned openings in the ends of said side and end members for the receipt of a finial of the bed.

3. The structure of claim 2 in which one of said member openings is enlarged to permit adjustment of the connection thereof to said finial.

4. A lightweight rugged canopy frame for a bed comprising a pair of side members and a plurality of transverse members all constructed of tubular metal, said side members each including a pair of end connected sections with one section having a constricted end telescopically received in the other, each pair of sections when connected forming an arch midway of the length thereof, each section being formed into a tube with a longitudinally extending lock seam, said constricted end being equipped with a longitudinally extending groove in which the lock seam of the connected section is received to orient each pair of sections in arch providing relation, said transverse members including a pair of end members each being formed into a tube with a lock seam extending longitudinally with respect to the length of said end member, said side and end members being equipped with openings adjacent the ends thereof for connection to the bedposts, said transverse members also including a plurality of intermediate members each formed into a tube with a butt seam, said intermediate members being crimped at the ends thereof to provide a generally L-shaped flange at each end, said side members being equipped with elongated slots in transversely aligned, longitudinally spaced apart positions to receive said flanges, said frame being assembled by inserting the outer leg of said L-shape into an associated slot and thereafter rotating the said side member section to insert the inner leg of said L-shape in said slot whereby said outer legs cooperate to lock said frame in arch providing attitude.

5. A method of assembling a canopy frame for a bed having opposed, sectioned side members equipped with a central arch were two sections are joined and intermediate transverse members connecting said members at longitudinally spaced portions, comprising providing longitudinally extending slots in said side members and generally L-shaped flanges at the ends of said intermediate transverse members, first inserting the outer legs of said L-shaped flanges in said slots of a pair of opposed sections while said side member sections have the arch portions thereof in a generally horizontal plane and thereafter rotating said side member sections to orient the same with the arch portions thereof in a vertical plane while simultaneously introducing the inner legs of said flanges into said slots, and thereafter connecting the associated sections of said side member to complete the arch thereof.

* * * * *